United States Patent [19]

Tea

[11] 4,311,092

[45] Jan. 19, 1982

[54] LOW-PROFILE VERTICAL BALING MACHINE

[75] Inventor: Frank C. Tea, Bellevue, Ohio

[73] Assignee: The American Baler Company, Bellevue, Ohio

[21] Appl. No.: 105,225

[22] Filed: Dec. 19, 1979

[51] Int. Cl.[3] ..... B30B 15/06

[52] U.S. Cl. ..... 100/214; 49/445; 100/220; 100/231; 100/252; 100/255; 100/269 R; 100/295

[58] Field of Search ..... 100/214, 215, 245, 240, 100/269 R, 295, 229 A, 231, 220, 255, 252; 49/445

[56] References Cited

U.S. PATENT DOCUMENTS

| | | | |
|---|---|---|---|
| 791,746 | 6/1905 | Barngrover | 100/295 |
| 3,757,680 | 9/1973 | Williams | 100/269 R |
| 3,862,595 | 1/1975 | Longo | 100/229 A |
| 4,041,856 | 8/1977 | Fox | 100/245 |

FOREIGN PATENT DOCUMENTS

| | | | |
|---|---|---|---|
| 928149 | 5/1955 | Fed. Rep. of Germany | 49/445 |
| 1163857 | 5/1958 | France | 49/445 |
| 599013 | 5/1978 | Switzerland | 100/229 A |

*Primary Examiner*—Billy J. Wilhite

*Attorney, Agent, or Firm*—Pearne, Gordon, Sessions, McCoy & Granger

[57] ABSTRACT

A baling machine is disclosed having a single ram means horizontally spaced from the baling chamber to reduce the overall height of the baling machine, while avoiding the complications of two side-mounted ram means. The baling machine includes a vertically movable platen which is supported on a sleeve which is mounted around and supported on a vertically extending support column horizontally spaced from the baling chamber. The ram means is preferably located between the support column and the baling chamber in a position which extends substantially below the top of the baling chamber.

14 Claims, 9 Drawing Figures

LOW-PROFILE VERTICAL BALING MACHINE

BACKGROUND OF THE INVENTION

1. Field of the Invention

This invention relates to baling machines of the type used to press or compact waste material such as cans and fibrous materials, and particularly to such a baling machine in which the platen or baling head moves vertically.

2. Description of the Prior Art

Vertical or downstroke baling machines for waste material are commonly used to bale aluminum beverage cans, tin cans, other non-ferrous scrap, and secondary fiber materials. These baling machines commonly comprise a housing or cabinet having a baling chamber therein and having a vertically movable upper front door which may be opened for the insertion of material to be baled into the chamber and having a hinged lower front door which is opened to remove the bale of material from the chamber. A platen is mounted to be vertically movable within the baling chamber. The platen is in its raised upper position for the insertion of waste material into the baling machine, and is moved downwardly to compress the material into the finished bale. The platen is pushed downwardly by suitable hydraulic ram means.

Prior art baling machines of this type have commonly utilized a single hydraulic cylinder on top of the baling machine to serve as a ram means for pushing the platen downwardly. The top-mounted hydraulic cylinder, however, occupied considerable space above the machine and resulted in a baling machine having an excessive height. Because of its height, such a baling machine could not be located in many standard size rooms or work areas where the ceiling is less than the overall height of the machine. In some instances, in order to accommodate these baling machines, users have cut holes in ceilings to provide sufficient clearance for the machines.

To reduce the overall height of such baling machines, other types of machines have been developed which have a pair of side-mounted hydraulic cylinders instead of a single top-mounted cylinder. While the pair of side-mounted cylinders have resulted in a reduction in the overall height of the baling machine, the two-cylinder design required costly and complicated hydraulic valving to assure that the cylinders operated uniformly and simultaneously to pull the platen down equally on both sides. If the operation of one cylinder was not exactly equal to that of the other cylinder, the platen may jam, or serious damage could result in the baling machine. As a result, the hydraulic supply system for the two-cylinder baling machine must be designed in such a manner that it assures that both cylinders operate together. This design often requires special balancing means to assure that equal amounts of hydraulic fluid are supplied to both cylinders and other specialized and complicated components.

An example of one type of baling machine having two hydraulic cylinders is shown in U.S. Pat. No. 4,041,856, issued to Fox, in which the two cylinders are shown mounted diagonally above the platen. While this design also served to reduce the overall height of the baling machine, it required two cylinders, and thus a complicated hydraulic supply system, to assure uniform operation of both cylinders.

SUMMARY OF THE INVENTION

The present invention provides a vertical or downstroke baling machine having a single cylinder and having a reduced overall height comparable to baling machines having two cylinders. The present invention provides a baling machine having a low profile or reduced vertical height so that the machine may be placed in areas of minimal vertical clearance where single cylinder vertical baling machines of the prior art having top-mounted cylinders would not fit.

The present invention also provides a baling machine having a single hydraulic cylinder which avoids the complications and expense of hydraulic systems which must supply two hydraulic cylinders operating together, which systems usually include complex balancing means to assure that equal amounts of hydraulic fluid are supplied to both machines. The baling machine of the present invention also requires a smaller hydraulic reservoir and smaller hydraulic pump than the prior art machines which must operate with two cylinders. By eliminating the disadvantages associated with machines having two hydraulic cylinders, the baling machine of the present invention provides a more reliable apparatus which is less likely to jam or be damaged, since there is no problem of one hydraulic cylinder operating out of balance with respect to the other hydraulic cylinder. The baling machine of the present invention is extremely dependable and relatively inexpensive in comparison to machines having two cylinders and the associated larger and more complicated hyraulic system.

The present invention relates to a vertical baling machine comprising a baling chamber and a vertically extending support column horizontally spaced from the baling chamber. A sleeve is mounted around the support column and is vertically movable thereon. A platen is vertically movable within the baling chamber. The platen is mounted on the sleeve and is supported thereby. Ram means for vertically moving the platen are connected to the platen and are horizontally spaced from the baling chamber. By locating the ram means horizontally spaced and respect to the baling chamber instead of on top of the baling chamber, the overall height of the machine is reduced.

DETAILED DESCRIPTION OF THE PREFERRED EMBODIMENT

Figure 1:
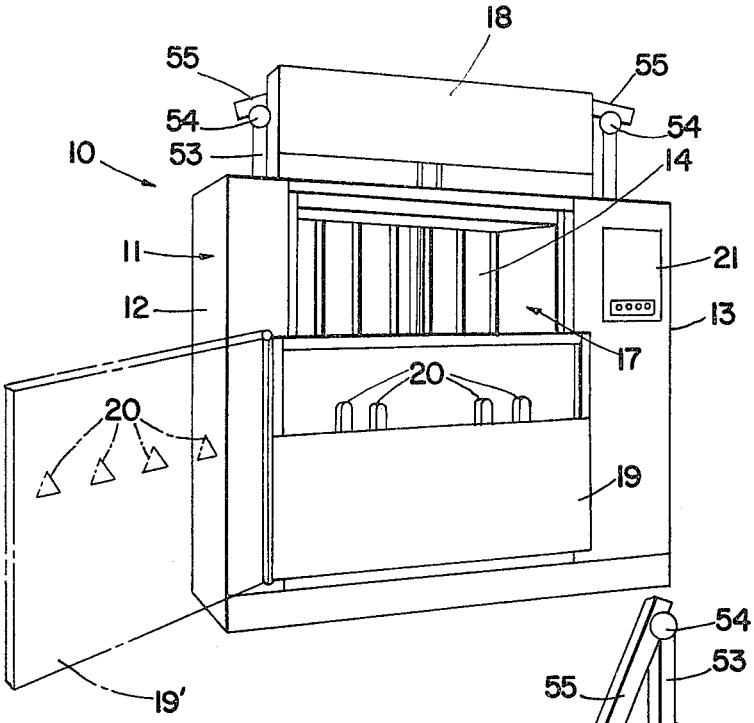
FIG. 1 is a front perspective view of the baling machine of the present invention.
Figure 2:
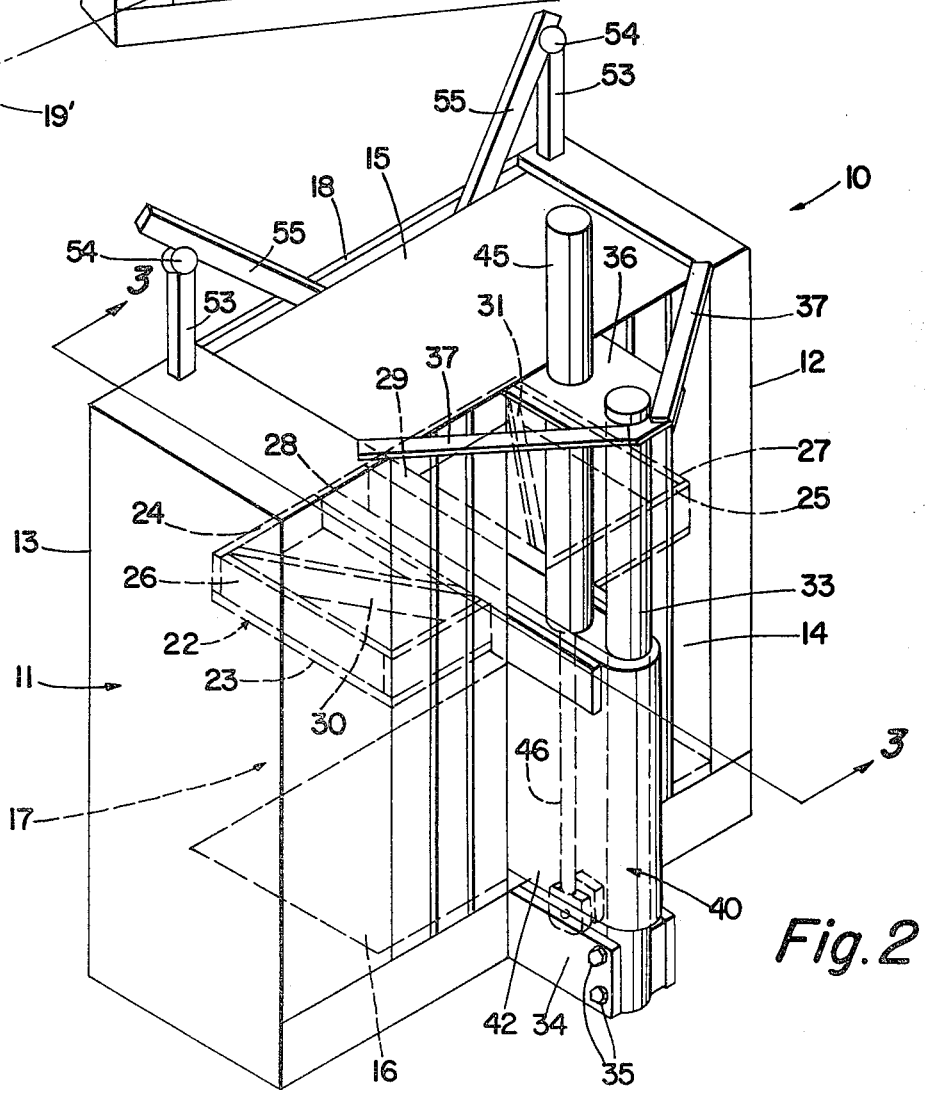
FIG. 2 is a rear perspective view of the baling machine of FIG. 1.

Referring more particularly to the drawings, and initially to FIGS. 1 and 2, there is shown a baling machine 10 of the present invention. The baling machine 10 comprises a rectangular cabinet 11 having sides 12 and 13, a slotted rear wall 14, a top 15, and a floor 16. A baling chamber 17 is formed within the cabinet 11. The cabinet 11 is of generally known design which is typical of downstroke baling machines of the prior art. The rear wall 14 comprises a plurality of vertically extending, U-shaped members having vertically extending slots therebetween. The slots permit the entry of bale ties such as wires or straps, which may be used to wrap around the finished bale in accordance with known baling principles.

On the front of the cabinet 11, the baling chamber 17 is enclosed by a vertically movable upper door 18 and a side-hinged lower door 19. The upper door 18 is adapted to be raised to its upper position, as shown in FIG. 1, to permit the material to be baled, such as aluminum or tin cans, non-ferrous scrap, cardboard containers, and other secondary fiber materials, to be fed into the baling chamber 17. After compression of the material into a finished bale, the lower door may be opened, as indicated by the door 19' in FIG. 1, for easy removal of the bale. A suitable door latch is provided to maintain the lower door 19 securely closed during the baling operation. Preferably, the latch is interconnected with the control mechanism for the baling machine to assure that the lower door 19 is closed while the material in the baling chamber 17 is being compressed. The lower door 19 also includes a number of bale retainers 20. The floor 16 against which the material is compressed is approximately level with the bottom of the lower door 19 and may include a plurality of grooves extending from the rear to the front of the baling chamber, each groove being in approximately the same plane as one of the slots in the rear wall 14 to assist in tying the finished bales.

One side 13 of the cabinet 11 houses the hydraulic components of the baling machine, including a hydraulic reservoir, a hydraulic pump, and solenoid valves or other suitable means for actuating the flow of hydraulic fluid. On the front of the side 13 is a control panel 21 containing the controls for operation of the machine. Suitable electronic circuitry is connected behind the control panel 21 within the bearing 13 for operation of the machine.

As shown more fully in FIGS. 2–5, the baling chamber 17 contains a vertically movable, horizontally extending platen or baling head 22 which is moved downwardly to compress the material within the baling chamber against the floor 16. The platen 22 includes a bottom plate 23. The bottom plate 23 is reinforced around its periphery by a strut 24 on top of the plate 23 extending across the front of the plate, a parallel strut 25 extending across the rear of the plate, and a pair of side braces 26 and 27 extending across each side of the plate. A parallel pair of horizontally extending, heavy support beams 28 and 29 extend across the middle of the platen 22 to the front of the platen and project outwardly beyond the rear of the platen. A pair of diagonal braces 30 and 31 extend from the rearward portions of the beams 28 and 29 to the front corners of the platen 22.

The platen 22 is supported on a vertically extending support column 33 which is mounted at the rear of the cabinet 11. The bottom of the column 33 is connected to the bottom of the cabinet 11 by a bottom mounting bracket 34 which extends from the back of the cabinet 11 and is supported on the floor. A pair of bolts 35 or other suitable fastening means extends through the bracket 34 and the bottom of the support column 33 to secure the bottom of the column. The top of the support column 33 is mounted in a top supporting bracket 36 which extends from the back of the top 15 of the cabinet 11. A pair of diagonal braces 37 may be provided to connect the outwardly projecting end of the bracket 36 with the sides 12 and 13 of the cabinet 11, further securing the top of the support column 33.

The platen 22 is supported on the column 33 by a sleeve 40 which extends around the column. The sleeve 40 includes a tubular portion 41 having an inner diameter only slightly larger than the outer diameter of the support column 33 and which is adapted to ride up and down on the support column. A vertically elongated U-shaped portion 42 extends around the tubular portion 41 and extends forwardly from the tubular portion toward the cabinet 11. The platen 22 is mounted at the top of the U-shaped portion 42 of the sleeve 40 by means of the support beams 28 and 29 which project rearwardly beyond the back of the platen 21 and which are secured to the outside of the upper part of the U-shaped portion 42, such as by welding or other suitable means. The platen 22 is thus securely mounted in its horizontally extending position on the support column 33 by means of the sleeve 40 and is adapted to be moved vertically as the sleeve rides up and down on the support column 33. If desired, the back and the sides of support column 33 may be enclosed by a suitable cover (not shown) so that the column 33 remains clean and so that debris, which may tend to jam the movement of the sleeve 40, does not accumulate on the column.

Figure 7:
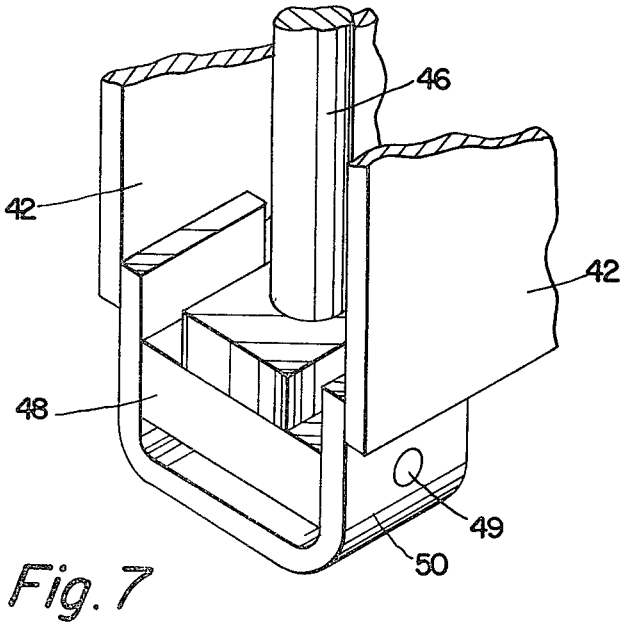
FIG. 7 is a detailed perspective view of the bottom of the ram and its attachment to the sleeve.

The vertical movement of the platen 22 is accomplished by a ram means comprising a hydraulic cylinder 45 which is mounted in the top supporting bracket 36. The hydraulic cylinder 45 is connected by suitable lines (not shown) to the hydraulic supply tank and the hydraulic pump housed within the side 13 of the cabinet. The cylinder 45 extends upwardly beyond the top 15 of the cabinet 11, but preferably extends upwardly no further than the upper limit of the vertically movable upper door 18, so that the position of the hydraulic cylinder 45 does not otherwise increase the overall height of the baling machine. The cylinder 45 contains a piston rod 46 which extends downwardly from the cylinder. The bottom end of the piston rod 46 is mounted to the bottom of the U-shaped portion 42 of the sleeve 40. As shown more fully in FIG. 7, a block 48 is attached to the bottom of the rod 46. The block 48 is mounted by means of a horizontally extending pin 49 to a U-shaped bracket 50, which is welded or otherwise suitably secured to the bottom of the sleeve portion 42. The bottom end of the rod 46 is thus pivotably mounted and attached to the bottom of the sleeve 40. This pivotal mounting of the piston rod 46 to the sleeve 40 accommodates some lateral movement by the sleeve, due to slight misalignment of the platen 22 during its downstroke or to uneven distribution of material within the baling chamber 12, and prevents any damage to the piston rod due to inadvertent bending of the piston rod by such lateral movement.

Figure 3:
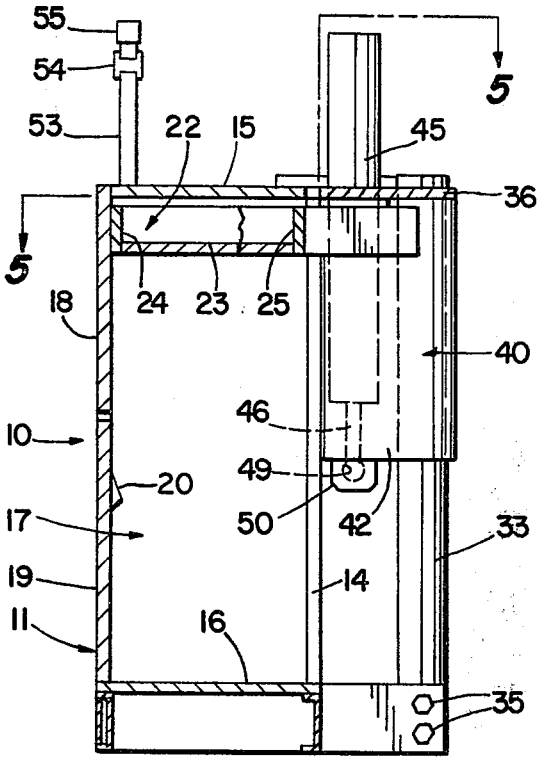
FIG. 3 is a side sectional view of the baling machine taken along line 3—3 of FIG. 2.
Figure 4:
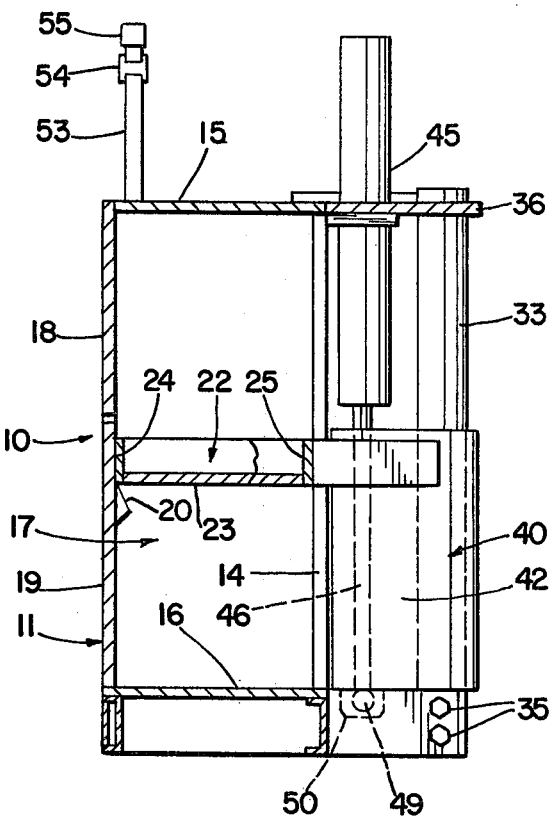
FIG. 4 is a side elevational view similar to FIG. 3, showing the same baling machine with the platen in its lowered position.
Figure 5:
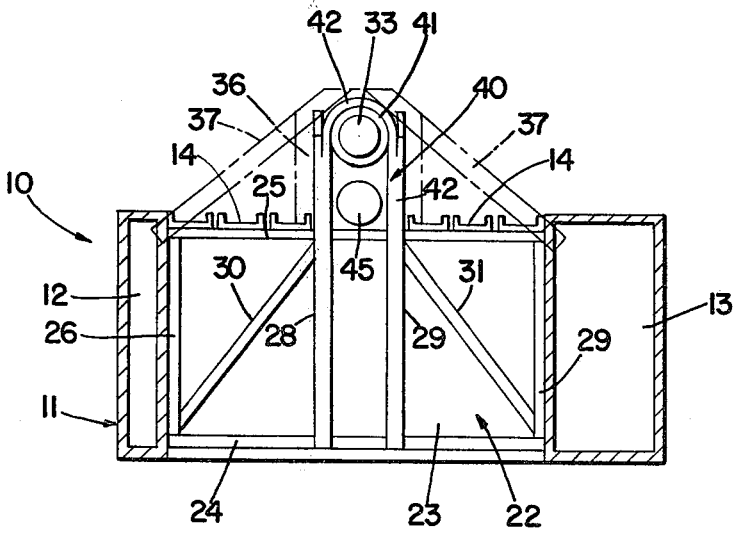
FIG. 5 is a top plan view of the baling machine taken along line 5—5 of FIG. 3.
Figure 6:
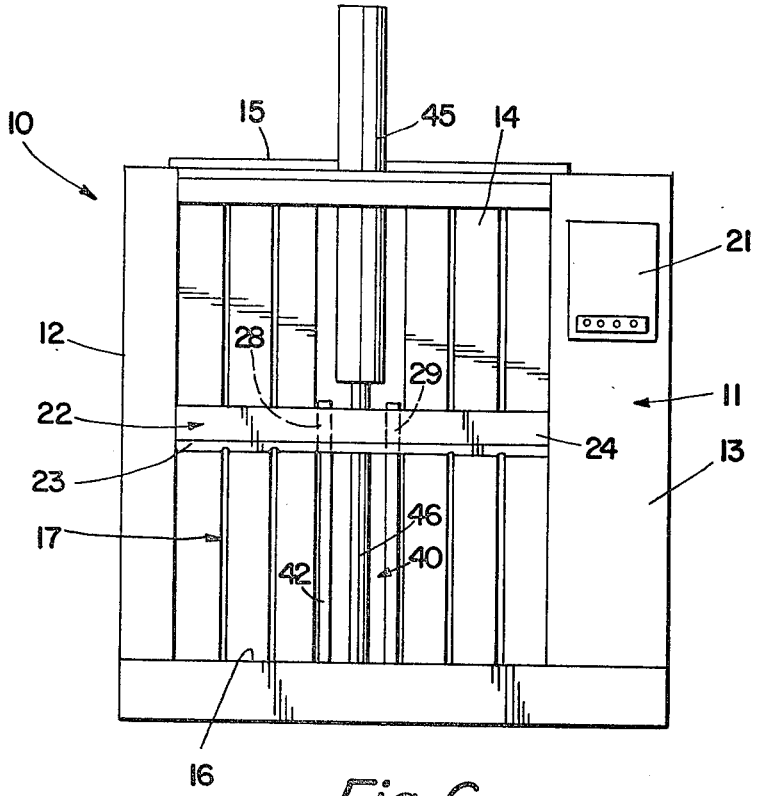
FIG. 6 is a front elevational view of the baling machine.

The vertical movement of the platen 22 can be seen by comparing FIGS. 3 and 4. In FIG. 3, the platen 22 is in its uppermost position. The piston rod 46 is fully retracted within the cylinder 45 and the sleeve 40 is in its uppermost position, with the top of the sleeve against the top supporting bracket 36. In this position, the upper door 18 may be opened to permit material to be placed into the baling chamber 17. Upon actuation of the hydraulic cylinder 45 by means of the hydraulic components contained in the side 13 of the cabinet as operated by the control panel 20, the piston rod 46 extends downwardly from the cylinder 45 and the sleeve 40 is moved downwardly on the support column 33 until the bottom of the sleeve is against the bottom supporting bracket 34. At this point, as shown in FIG. 4, the platen 22 is in its bottom position, fully compressing the material in the baling chamber 17 against the floor 16.

The platen 22 is fully supported on the sleeve 40, which includes the tubular portion 41 extending around the support column 33 for a substantial vertical distance. The upward vertical force on the platen 22 during the baling operation is thus absorbed by the support beams 28 and 29 and carried rearwardly to the sleeve 40, where this force results in a torque tending to push the top of the sleeve rearwardly and the bottom of the sleeve forwardly. This torque is resisted by the support of the substantial vertical extent of the tubular sleeve portion 41 on the support column 33, so that the platen 22 is fully supported during its downward movement by means to the rear of the platen. Thus, the ram means comprising the single cylinder 45 may also be mounted rearwardly of the platen 22 rather than on top of the platen, as in the past, resulting in a lower overall height to the complete baling machine 10.

Figure 8:
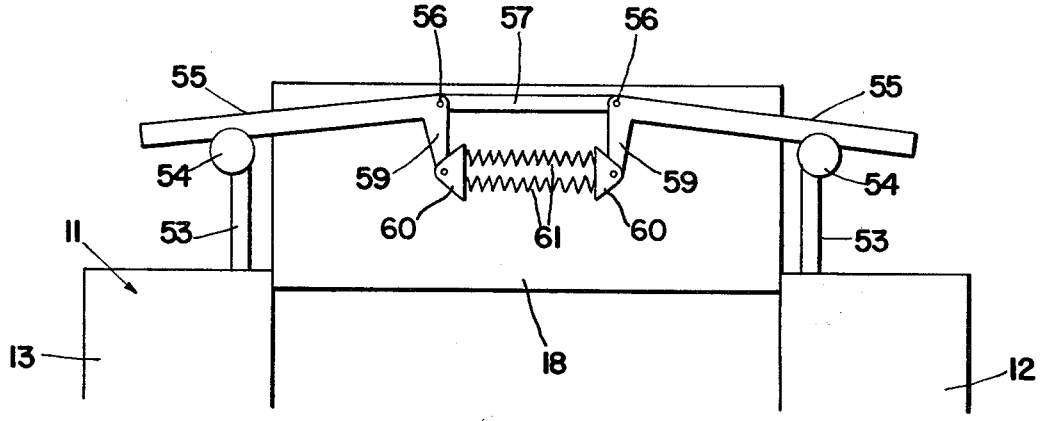
FIG. 8 is a rear elevational view of the top of the baling machine showing the support for the upper door.
Figure 9:
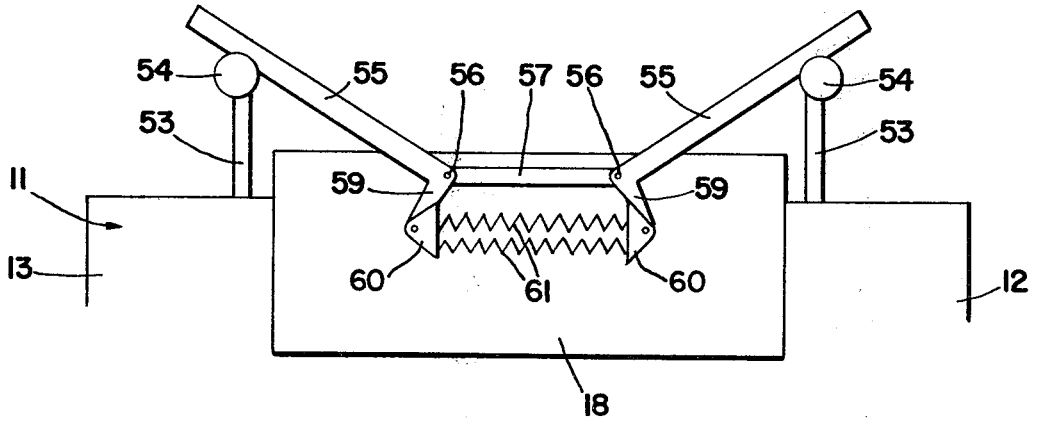
FIG. 9 is a rear elevational view similar to FIG. 8, showing the same door in its lowered position.

The support of the upper door 19 is shown in more detail in FIGS. 8 and 9. As shown therein, the upper door 18 is supported on a pair of upwardly extending door support members 53, which extend from the top 15 of the cabinet 11 at the front of the baling machine. At the top of each of the support members 53 is a roller 54 supporting the outwardly projecting end of an arm 55. The outer end of each of the arms 55 rests on top of the roller 54 and is free to move horizontally. The inner ends 56 of the arms 55 are attached to the top of the door 18. The two inner ends 56 of the arms 55 are pivotally attached to the door, so that the outer ends of the arms are free to move, and the ends 56 are spaced apart by a reinforcing member 57 which is mounted across the top of the door 18. Extending downwardly from the end 56 of each of the arms 55 is a connecting member 59 which is secured to and extends laterally from the arm 55. A spring mounting bracket 60 is pivotally connected to the bottom of each of the connecting members 59 and a pair of springs 61 extends between the connecting members 59.

When the upper door 18 is in its raised position as shown in FIG. 8, the arms 55 extend slightly upwardly as they extend inwardly from the outer support at the rollers 54 to the inner attachment to the door 18 at the ends 56. The connecting members 59 thus extend downwardly and slightly inwardly, maintaining the spring-mounted brackets 60 relatively close together so that the spring 61 is in a relaxed, compressed condition.

When the door 18 is lowered to its closed position as shown in FIG. 9, the arms 55 tip until they extend downwardly as they extend inwardly from the outer support at the rollers 54 to the inner attachment to the door 18 at the inner ends 56. The connecting members 59 are thus pivoted so that they extend outwardly and downwardly, moving the spring-mounted brackets 60 further apart and extending the spring 61. The extension of the springs 61 creates a counterbalancing force which balances the weight of the door 18, thus permitting the door to be raised and lowered easily. At the same time, when the door 18 is lowered and closed, since the force exerted by the springs 61 is slightly less than the weight of the door, any "bounce" of the door as it is closed is reduced or eliminated.

The cylinder 45, which is mounted in the top supporting bracket 36, may be lowered for shipping so that the top of the cylinder 45 is even with the top 15 of the cabinet 11. Upon installation of the baling machine on the site of operation, the cylinder 45 may then be raised and properly mounted in the top supporting bracket 36 as shown. This temporary lowering of the cylinder 45 further reduces the height of the baling machine for shipping purposes.

While the invention has been shown and described with respect to a specific embodiment thereof, it will be apparent to those skilled in the art that other variations and modifications of the specific form herein shown and described may be used without departing from the spirit and scope of the invention. Accordingly, the patent is not to be limited in scope and effect to the specific embodiment herein shown and described, nor in any other manner that is inconsistent with the extent to which the progress in the art has been advanced by the invention.

What is claimed is:

1. A baling machine which comprises:

a baling chamber;

a vertically extending support column horizontally spaced from the baling chamber;

an elongated sleeve mounted around the support column and vertically movable thereon;

a platen vertically movable within the baling chamber between an upper position and a lower position, said lower position being approximately at the mid-point of the length of the baling chamber, the platen mounted on the sleeve and supported thereby, the sleeve extending below the bottom of the platen, the length of the sleeve below the bottom of the platen being substantially as long as the distance between the bottom of the platen and the bottom of the baling chamber when the platen is in the lower position; and ram means for vertically moving the platen, the ram means horizontally spaced from the baling chamber and operatively connected to the platen.

2. A baling machine as defined in claim 1, wherein the ram means is operatively connected to the platen by being attached to the sleeve to vertically move the sleeve thereby and vertically move the platen supported by the sleeve.

3. A baling machine as defined in claim 1, wherein the ram means is a single fluid cylinder.

4. A baling machine as defined in claim 1, wherein the ram means is located in a position which extends substantially downwardly below the plane of the top of the baling chamber.

5. A baling machine as defined in claim 1, wherein the platen is mounted at the top of the sleeve.

6. A baling machine as defined in claim 1, wherein the sleeve includes a tubular portion which has an inner dimension generally the same as the outer dimension of the support column and which is adapted to move vertically thereon.

7. A baling machine as defined in claim 1, wherein the platen is generally rectangular in shape.

8. A baling machine as defined in claim 1, comprising in addition a vertically mounted front door, the door having a pair of arms pivotally mounted to the top of the door and extending outwardly on each side; support members extending upwardly from the baling chamber, the outer extending ends of the arms being freely supported on top of the support members; and a spring, each of the arms having a portion extending laterally from the arm and connected to the end of the spring, the spring adapted to be elongated when the door is lowered to counterbalance the weight of the door.

9. A baling machine which comprises:

a baling chamber;

a vertically extending support column horizontally spaced from the baling chamber;

a sleeve mounted around the support column and vertically movable thereon;

a platen vertically movable within the baling chamber, the platen mounted on the sleeve and supported thereby; and ram means for vertically moving the platen, the ram means being horizontally spaced from the baling chamber and located between the support column and the baling chamber, the ram means being operatively connected to the platen.

10. A baling machine which comprises:

a baling chamber;

a vertically extending support column horizontally spaced from the baling chamber;

an elongated sleeve mounted around the support column and vertically movable thereon;

a platen vertically movable within the baling chamber, the platen mounted on the sleeve and supported thereby, the sleeve extending below the bottom of the platen; and ram means for vertically moving the platen, the ram means being horizontally spaced from the baling chamber and attached to the bottom of the sleeve to vertically move the sleeve thereby and vertically move the platen supported by the sleeve.

11. A baling machine which comprises:

a baling chamber;

a vertically extending support column horizontally spaced from the baling chamber;

a sleeve mounted around the support column and vertically movable thereon;

a platen vertically movable within the baling chamber, the platen being mounted on the sleeve by a pair of horizontally extending support beams which extend across the platen and are secured to the sleeve, the platen supported thereby; and ram means for vertically moving the platen, the ram means being horizontally spaced from the baling chamber and operatively connected to the platen.

12. A baling machine which comprises:

a pair of sides, a rear wall, and a floor defining a baling chamber, a vertically movable front door closing at least a portion of the front of the baling chamber, the door having a pair of outwardly extending arms pivotally mounted to the top of the door;

support members extending upwardly from the top of the sides, each of the outwardly extending ends of the arms being supported on top of one of the support members;

a spring, each of the arms having a portion extending laterally from the arm and connected to the end of the spring, the spring adapted to be elongated as the door is lowered, the elongation of the spring counterbalancing the weight of the door;

a platen vertically movable within the baling chamber; and ram means for vertically moving the platen, the ram means being operatively connected to the platen.

13. A baling machine as defined in claim 12, comprising in addition:

a vertically extending support column horizontally spaced from the baling chamber; and a sleeve mounted around the support column and vertically movable thereon, the platen being mounted on the sleeve and supported thereby.

14. A baling machine which comprises:

a pair of sides, a rear wall, and a floor defining a baling chamber;

a vertically extending support column horizontally spaced from the rear wall;

a sleeve mounted around the support column and vertically movable thereon;

a platen vertically movable within the baling chamber, the platen having a pair of horizontally extending support beams which extend rearwardly from the platen beyond the rear wall, the support beams being secured to the sleeve and the platen supported thereby; and a hydraulic cylinder ram means for vertically moving the platen, the ram means connected to the bottom of the sleeve, the ram means located between the support column an the rear wall, and extending in a position which is substantially below the plane of the top of the baling chamber.

* * * * *

UNITED STATES PATENT AND TRADEMARK OFFICE

CERTIFICATE OF CORRECTION

PATENT NO. : 4,311,092

DATED : January 19, 1982

INVENTOR(S) : Frank C. Tea

It is certified that error appears in the above—identified patent and that said Letters Patent is hereby corrected as shown below:

Column 7, line 2, "mounted" should be "movable".

Column 8, line 49, "an" should be "and".

Signed and Sealed this

Sixth Day of April 1982

[SEAL]

*Attest:*

GERALD J. MOSSINGHOFF

*Attesting Officer*

*Commissioner of Patents and Trademarks*